US005857234A

United States Patent [19]

Hernnandez

[11] Patent Number: 5,857,234

[45] Date of Patent: Jan. 12, 1999

[54] PAINTBRUSH WITH SCRAPER

[76] Inventor: Miguel Hernnandez, 955 Boxwood, Lewisville, Tex. 75067

[21] Appl. No.: 78,057

[22] Filed: May 31, 1998

[51] Int. Cl.[6] ..... A47L 13/12

[52] U.S. Cl. ..... 15/111; 15/236.01; 30/169; D4/118; D32/42; D32/49

[58] Field of Search ..... 15/111, 113, 236.01; 30/169; D4/118; D32/42, 46–49

[56] References Cited

U.S. PATENT DOCUMENTS

| | | | |
|---|---|---|---|
| 181,206 | 8/1876 | Richardson | 15/111 |
| 428,491 | 5/1890 | Hortman | 15/111 |
| 598,349 | 2/1898 | Permento | 15/113 |
| 926,894 | 7/1909 | Pushee | 15/111 |
| 1,421,478 | 7/1922 | Hope | 15/111 |
| 1,430,441 | 9/1922 | Forsberg et al. | 15/111 |
| 1,605,305 | 11/1926 | Vinje | 15/111 |
| 2,533,838 | 12/1950 | Ranft | 15/111 |
| 3,398,419 | 8/1968 | Carlos | 15/111 |
| 5,351,350 | 10/1994 | Johnson | 7/105 |
| 5,419,000 | 5/1995 | Amato et al. | 15/111 |

FOREIGN PATENT DOCUMENTS

| | | | |
|---|---|---|---|
| 167125 | 4/1934 | Switzerland | 15/113 |
| 15478 | 8/1895 | United Kingdom | 15/113 |

*Primary Examiner*—Mark Spisich
*Attorney, Agent, or Firm*—Joseph N. Breaux

[57] ABSTRACT

A paintbrush with scraper that includes a paintbrush having brush bristles attached to a brush handle, and a pivoting scraper blade that pivots into and is stored within a scraper blade recess formed within the brush handle, the pivoting scraper blade being lockable in a use position by a blade locking mechanism including a pivot member pivotally and slidably mounted on a pivoting shaft of a pivot shaft member, the pivot member having a pivot shaft guide passageway formed therein and a position locking pin extending therefrom; the pivot shaft member having the pivoting shaft extending therefrom and into the pivot shaft guide passageway, a mounting plate secured to the surface of scraper blade recess of the brush handle and two locking pin receiving channels formed therein; the position locking pin being positionable into one of the two locking pin receiving channels when the scraper blade is stored within the scraper blade recess formed within the brush handle; the position locking pin being positionable in the other one of the two locking pin receiving channels when the pivoting scraper blade is extended fully into the use position; the pivoting scraper blade being integrally formed with the pivot member.

2 Claims, 1 Drawing Sheet

PAINTBRUSH WITH SCRAPER

TECHNICAL FIELD

The present invention relates to painting equipment and more particularly to a paintbrush with scraper that includes a paintbrush having brush bristles attached to a brush handle, and a pivoting scraper blade that pivots into and is stored within a scraper blade recess formed within the brush handle, the pivoting scraper blade being lockable in a use position by a blade locking mechanism including a pivot member pivotally and slidably mounted on a pivoting shaft of a pivot shaft member, the pivot member having a pivot shaft guide passageway formed therein and a position locking pin extending therefrom; the pivot shaft member having the pivoting shaft extending therefrom and into the pivot shaft guide passageway, a mounting plate secured to the surface of scraper blade recess of the brush handle and two locking pin receiving channels formed therein; the position locking pin being positionable into one of the two locking pin receiving channels when the scraper blade is stored within the scraper blade recess formed within the brush handle; the position locking pin being positionable in the other one of the two locking pin receiving channels when the pivoting scraper blade is extended fully into the use position; the pivoting scraper blade being integrally formed with the pivot member.

BACKGROUND OF INVENTION

To achieve superior results when painting, the surface to be painted must be properly prepared. Despite all efforts to completely prepare the surface prior to applying paint, it is often the case that some areas will be need additional surface preparation such as scraping before paint should be applied. It would be a benefit, therefore, to have a paintbrush that included a readily deployed scraper blade that could be deployed and used to scrape small areas prior to applying paint thereover.

SUMMARY OF INVENTION

It is thus an object of the invention to provide a paintbrush with scraper that includes a readily deployed scraper blade.

It is a further object of the invention to provide a paintbrush with scraper that includes a paintbrush having brush bristles attached to a brush handle, and a pivoting scraper blade that pivots into and is stored within a scraper blade recess formed within the brush handle, the pivoting scraper blade being lockable in a use position by a blade locking mechanism including a pivot member pivotally and slidably mounted on a pivoting shaft of a pivot shaft member, the pivot member having a pivot shaft guide passageway formed therein and a position locking pin extending therefrom; the pivot shaft member having the pivoting shaft extending therefrom and into the pivot shaft guide passageway, a mounting plate secured to the surface of scraper blade recess of the brush handle and two locking pin receiving channels formed therein; the position locking pin being positionable into one of the two locking pin receiving channels when the scraper blade is stored within the scraper blade recess formed within the brush handle; the position locking pin being positionable in the other one of the two locking pin receiving channels when the pivoting scraper blade is extended fully into the use position; the pivoting scraper blade being integrally formed with the pivot member.

It is a still further object of the invention to provide a paintbrush with scraper that accomplishes the above objects in combination.

Accordingly, a paintbrush with scraper is provided. The paintbrush with scraper includes a paintbrush having brush bristles attached to a brush handle, and a pivoting scraper blade that pivots into and is stored within a scraper blade recess formed within the brush handle, the pivoting scraper blade being lockable in a use position by a blade locking mechanism including a pivot member pivotally and slidably mounted on a pivoting shaft of a pivot shaft member, the pivot member having a pivot shaft guide passageway formed therein and a position locking pin extending therefrom; the pivot shaft member having the pivoting shaft extending therefrom and into the pivot shaft guide passageway, a mounting plate secured to the surface of scraper blade recess of the brush handle and two locking pin receiving channels formed therein; the position locking pin being positionable into one of the two locking pin receiving channels when the scraper blade is stored within the scraper blade recess formed within the brush handle; the position locking pin being positionable in the other one of the two locking pin receiving channels when the pivoting scraper blade is extended fully into the use position; the pivoting scraper blade being integrally formed with the pivot member.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY EMBODIMENTS

Figure 1:
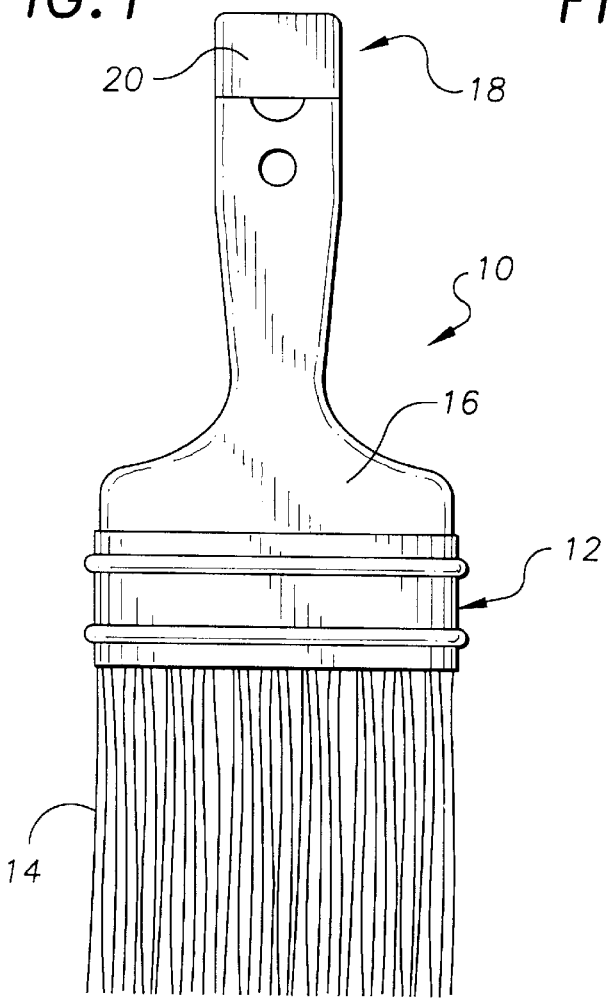
FIG. 1 is a wide side plan view of an exemplary embodiment of the paintbrush with scraper of the present invention showing the brush bristles, the brush handle, and the pivoting scraper blade pivoted into and stored within the scraper blade recess of the brush handle.
Figure 2:
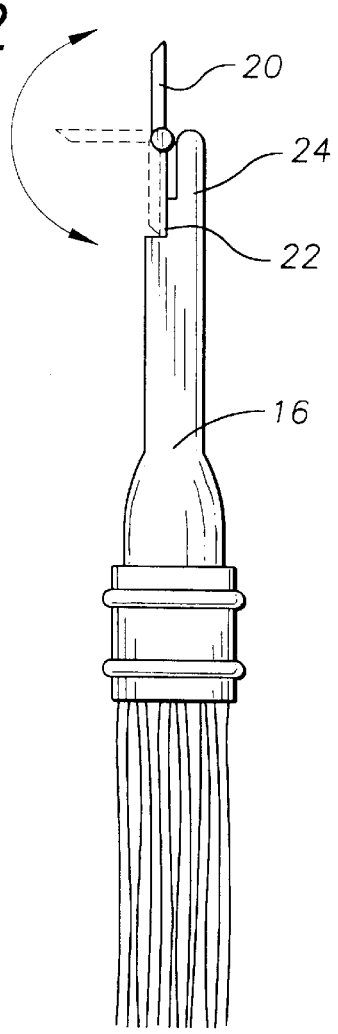
FIG. 2 is a thin side plan view of the exemplary paintbrush with scraper of FIG. 1 showing the brush bristles, the brush handle, and the pivoting scraper blade pivoted out of the scraper blade recess of the brush handle and locked in place with the blade locking mechanism.

FIG. 1 shows an exemplary embodiment of the paintbrush with scraper of the present invention generally designated by the numeral 10. In this embodiment, paintbrush with scraper 10 includes a conventional paintbrush, generally designated 12, having natural fiber brush bristles 14 attached to a wooden brush handle 16, and a pivoting scraper blade assembly, generally designated 18, including a steel scraper blade 20 that pivots into and is stored within, with reference now to FIG. 2, a scraper blade recess 22 formed within the top 24 of brush handle 16.

Figure 3:
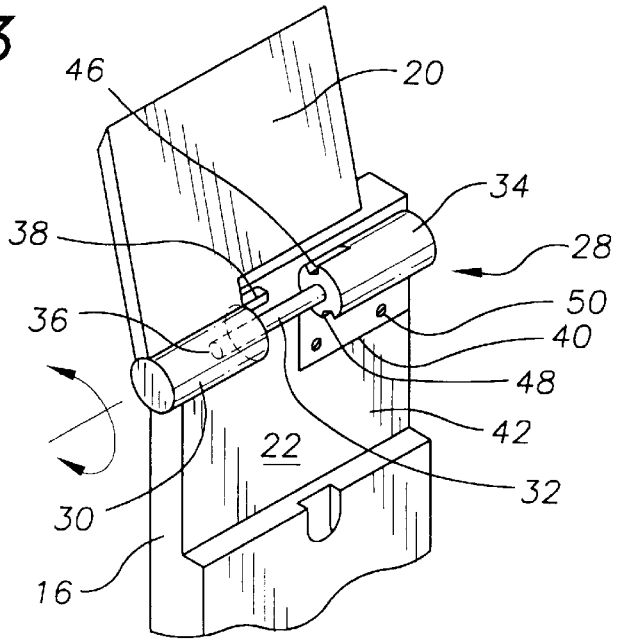
FIG. 3 is a detail perspective view of the pivoting scraper blade and blade locking mechanism showing the pivoting member of the blade locking mechanism with the pivot guide passageway formed therein and the position locking pin extending therefrom; and the pivot shaft member of the blade locking mechanism showing the pivoting shaft, the mounting plate screwed to the surface of scraper blade recess of the brush handle and the two locking pin receiving channels; and the scraper blade portion formed integrally with the pivoting member of the blade locking mechanism.

With reference now to FIG. 3, scraper blade 20 is lockable in a use position by a blade locking mechanism, generally designated 28 that includes a pivot member 30 that is pivotally and slidably mounted on a pivoting shaft 32 of a pivot shaft member 34. Pivot member 30 has a pivot shaft guide passageway 36 (shown in dashed lines) formed therein and a position locking pin 38 that extends therefrom. Pivoting shaft 32 extends from pivot shaft member 34 and has an end portion thereof slidably entrapped within pivot shaft guide passageway 36. Pivot shaft member 34 also includes a mounting plate 40 and a first and second locking pin receiving channels 46,48. Mounting plate 40 is secured to the surface 42 of brush handle 16 that partially defines scraper blade recess 22 with a number of screws 50. Position locking pin 38 is positioned into first locking pin receiving channel 46 to lock scraper blade 20 in the use position and is positioned into second locking pin receiving channel 48 to lock scraper blade 20 in the stored position within scraper blade recess 22.

It can be seen from the preceding description that a paintbrush with scraper has been provided that includes a readily deployed scraper blade and that includes a paintbrush having brush bristles attached to a brush handle, and a pivoting scraper blade that pivots into and is stored within a scraper blade recess formed within the brush handle, the pivoting scraper blade being lockable in a use position by a blade locking mechanism including a pivot member pivotally and slidably mounted on a pivoting shaft of a pivot shaft member, the pivot member having a pivot shaft guide passageway formed therein and a position locking pin extending therefrom; the pivot shaft member having the pivoting shaft extending therefrom and into the pivot shaft guide passageway, a mounting plate secured to the surface of scraper blade recess of the brush handle and two locking pin receiving channels formed therein; the position locking pin being positionable into one of the two locking pin receiving channels when the scraper blade is stored within the scraper blade recess formed within the brush handle; the position locking pin being positionable in the other one of the two locking pin receiving channels when the pivoting scraper blade is extended fully into the use position; the pivoting scraper blade being integrally formed with the pivot member.

It is noted that the embodiment of the paintbrush with scraper described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A paintbrush with scraper comprising:

a paintbrush having brush bristles attached to a brush handle; and a pivoting scraper blade that pivots into and is stored within a scraper blade recess formed within said brush handle, said pivoting scraper blade being lockable in a use position by a blade locking mechanism including a pivot member pivotally and slidably mounted on a pivoting shaft of a pivot shaft member, said pivot member having a pivot shaft guide passageway formed therein and a position locking pin extending therefrom;

said pivot shaft member having said pivoting shaft extending therefrom and into said pivot shaft guide passageway, a mounting plate secured to a surface of said scraper blade recess of said brush handle and two locking pin receiving channels formed therein;

said position locking pin being positionable into one of said two locking pin receiving channels when said scraper blade is stored within said scraper blade recess formed within said brush handle;

said position locking pin being positionable in an other one of said two locking pin receiving channels when said pivoting scraper blade is extended fully into said use position.

2. The paintbrush with scraper of claim 1, wherein:

said pivoting scraper blade is integrally formed with said pivot member.

* * * * *